US007226401B2

(12) United States Patent
Van Stratten et al.

(10) Patent No.: US 7,226,401 B2
(45) Date of Patent: Jun. 5, 2007

(54) EXERCISE MACHINE

(75) Inventors: Willem Johannes Van Stratten, Sandton (ZA); Michael Roydon Puzey, Sandton (ZA)

(73) Assignee: Greenhouse International LLC, Elkton, MD (US)

( * ) Notice: Subject to any disclaimer, the term of this patent is extended or adjusted under 35 U.S.C. 154(b) by 461 days.

(21) Appl. No.: 10/611,984

(22) Filed: Jul. 3, 2003

(65) Prior Publication Data

US 2004/0138033 A1 Jul. 15, 2004

(30) Foreign Application Priority Data

Jan. 15, 2003 (ZA) ..... 2003/0392

(51) Int. Cl.
*A63B 21/008* (2006.01)

(52) U.S. Cl. ..... 482/112; 482/138; 482/142

(58) Field of Classification Search ..... 482/92, 482/123, 111–113, 133, 134, 138, 130, 142, 482/148

See application file for complete search history.

(56) References Cited

U.S. PATENT DOCUMENTS

| | | | | |
|---|---|---|---|---|
| 3,387,843 | A | 6/1968 | Chandler | |
| 3,944,221 | A * | 3/1976 | Berkestad et al. | 482/112 |
| 4,183,520 | A * | 1/1980 | Chase | 482/112 |
| 4,227,689 | A | 10/1980 | Keiser | |
| 4,257,593 | A | 3/1981 | Keiser | |
| 4,333,645 | A * | 6/1982 | Wu | 482/112 |
| 4,397,462 | A | 8/1983 | Wilmarth | |
| 4,728,101 | A | 3/1988 | King | |
| 4,801,139 | A | 1/1989 | Vanhoutte et al. | |
| 4,826,156 | A * | 5/1989 | Dreier | 482/112 |
| 4,832,335 | A * | 5/1989 | Tong | 482/112 |
| 4,911,438 | A | 3/1990 | Van Straaten | |
| 5,029,850 | A | 7/1991 | van Straaten | |
| 5,232,426 | A | 8/1993 | Van Straaten | |
| 5,310,394 | A * | 5/1994 | Kallios | 482/104 |
| 5,312,315 | A | 5/1994 | Mortensen et al. | |
| 5,403,257 | A | 4/1995 | Lehtonen | |
| 5,658,222 | A | 8/1997 | Brown | |
| D389,205 | S | 1/1998 | van Straaten | |
| 5,709,638 | A | 1/1998 | Mackert et al. | |
| 5,718,659 | A | 2/1998 | Van Straaten | |
| 5,890,996 | A | 4/1999 | Frame et al. | |
| 6,375,598 | B1 | 4/2002 | Frame et al. | |
| 2002/0025890 | A1 | 2/2002 | Keiser | |
| 2004/0138032 | A1 * | 7/2004 | Van Straaten et al. | 482/112 |

FOREIGN PATENT DOCUMENTS

| | | |
|---|---|---|
| EP | 0 614 683 A1 | 4/1994 |
| EP | 1 243 809 A2 | 9/2002 |
| GB | 650009 | 2/1951 |
| WO | WO 2004062740 A1 * | 7/2004 |
| WO | WO 2004062741 A1 * | 7/2004 |
| WO | WO 2004062743 A1 * | 7/2004 |

* cited by examiner

*Primary Examiner*—(Jackie) Tan-Uyen T. Ho
*Assistant Examiner*—Victor K. Hwang
(74) *Attorney, Agent, or Firm*—Young & Thompson

(57) ABSTRACT

An exercise machine which includes an elongate frame which forms an enclosure, a resistance assembly located at least partly in the enclosure, a support member for supporting the frame at an inclined position with an upwardly facing front side and a downwardly facing rear side, a seat extending from the front side of the frame at a location at which part of the frame opposes a back of a user seated on the seat, and at least a first actuator which is movable by the user against a first resistance force which is generated by the resistance assembly.

19 Claims, 10 Drawing Sheets

EXERCISE MACHINE

BACKGROUND OF THE INVENTION

This invention relates to an exercise machine.

Exercise machines make use of diverse devices such as free weights, weight plates, elastic bands, springs and the like to provide a resistance force against which a user can exercise. It has been found that, in many of these machines, the stroke length, which is the distance against which a user moves his arms or legs, as the case may be, against a resistive force, must be reasonably long and this, in turn, means that an exercise machine must also be of substantial dimensions.

It is preferable to have a substantially constant resistance force, against which a user exercises, over the stroke length. If use is made of a spring or similar component, to provide the resistance force then, as is known, the spring characteristic is such that the resistance force increases more or less linearly with spring deformation. In other words the more the resistance device is moved the greater is the resistance force which acts against movement from the user. This is not necessarily a desirable characteristic.

If one or more weights are used to provide the resistance force then a substantially constant resistance force is obtained over the stroke length. When a user who is physically strong makes use of the exercise machine then the number of weights which must be provided is substantial and this carries with it a penalty in that the exercise machine is then not necessarily easily transportable and, inevitably, the exercise machine is cumbersome and expensive to ship to a customer.

Another factor is that the positive resistance force, which is the resistance force displayed by the resistance device when energy is put into an exercise machine by a user, should, as far as is possible, be the same as the negative resistance force which results when energy which is stored in the exercise machine is released, on a return stroke. These forces can only be matched to one another, at least to some extent, if frictional and similar losses are minimised.

It should be possible, particularly for a device which is intended for a home user, to be able to adjust the resistance force, exhibited by an exercise machine, with relative ease. The exercise machine should, as noted, be compact and light so that it is suited for easy transport and storage, particularly for the home user. It is also desirable to be able to use the machine in one of at least two modes eg. by working against a resistance force by pulling downwardly on an actuator which may be of any suitable form eg. a handle, a bar, an ankle or wrist cuff, or the like, or by working against a resistance force by pulling upwardly on an actuator. These modes are given merely by way of example for the exercise machine could be constructed to provide the resistance force against other types of movement eg. a pushing or a rotating movement by the user.

SUMMARY OF INVENTION

The invention provides an exercise machine which includes an elongate frame with opposed upper and lower ends and opposed sides which form an enclosure, a resistance assembly inside the enclosure, a support member which supports the frame at an inclined position with the lower end on the ground whereby the frame on one side has an inclined upwardly facing surface and, on an opposing side, an inclined downwardly facing surface, a seat which is mounted to the frame between the upper and lower ends of the frame and which, at an operative position, extends from the inclined upwardly facing surface, at least a first handle at the upper end of the frame which is movable by a user, on the seat, against a first resistance force which is generated by the resistance assembly, and at least a second handle at the lower end of the frame which is movable by the user, on the seat, against a second resistance force which is generated by the resistance assembly.

Preferably the seat is movable from the operative position to a first storage position at which the seat overlies a first part of the enclosure.

The exercise machine may include a footpiece at the lower end of the frame which, at an operative position, rests on the ground to receive at least one foot of a user on the seat.

The footpiece may be movable from the operative position to a second storage position at which the footpiece overlies a second part of the enclosure.

The exercise machine may include at least one control for controlling the first and the second resistance forces. The at least one control may be mounted to the footpiece.

In one form of the invention the resistance assembly includes at least first and second components which are movable relatively to each other and wherein the first component is movable by means of one of the first and second handles relatively to the second component and to the frame, and the second component is movable by means of the other of the first and second handles, relatively to the first component and to the frame. Preferably the first component is a cylinder and the second component is an elongate member which is mounted, at least partly inside the cylinder, for reciprocating movement in its longitudinal direction relatively to the cylinder.

Preferably a backrest is mounted to the frame above the seat.

The exercise machine may include at least one support which extends from the upper end of the frame and at least the first handle may be supported by the support whereby the user, on the seat, can cause the at least first handle to move downwardly relatively to the support against the first resistance force.

The exercise machine may include a first mechanical advantage system connected to the resistance assembly whereby movement of the first handle by a first distance causes corresponding movement of at least a first part of the resistance assembly by a second distance which is smaller than the first distance. With this embodiment the resistance assembly may include first and second ends and, when the at least first part of the assembly is caused to move by the first handle, the first end engages with a first support on the frame and the second end moves relatively to the frame.

The exercise machine may include a second mechanical advantage system connected to the resistance assembly whereby movement of the second handle by a third distance causes corresponding movement of at least a second part of the resistance assembly by a fourth distance which is smaller than the third distance.

According to a different aspect of the invention there is provided an exercise machine which includes a frame, a resistance assembly supported by the frame, a first actuator which is movable by a user from a first rest position against a first resistance force which is dependent at least on the resistance assembly, to cause movement of at least a first part of the resistance assembly, the first actuator including at least a first device which is movable by the user and a first mechanical advantage system connected to the resistance assembly whereby movement of the first device by a first distance causes corresponding movement of the at least first part of the resistance assembly by a second distance which is smaller than the first distance, a second actuator which is movable by the user from a second rest position against a second resistance force which is dependent at least on the resistance assembly, to cause movement of at least a second part of the resistance assembly, the second actuator including at least a second device which is movable by the user and a second mechanical advantage system connected to the resistance assembly whereby movement of the second device by a third distance causes corresponding movement of the at least second part of the resistance assembly by a fourth distance which is smaller than the third distance.

The first mechanical advantage system may, in a relatively simple form, comprise a cable and pulley system. The system may be designed so that movement of the first actuator through the first distance is greater than the corresponding resulting movement of the resistance assembly through the second distance. The mechanical advantage, in this respect, may be of the order of 2:1 but, preferably, is of the order of 4:1. Other ratios are possible. This feature carries with it the benefit that the stroke length is materially increased compared to the distance by which the resistance assembly is caused to move. The second mechanical advantage system may be similar in nature.

It is important however to minimize frictional energy losses, particularly in a cable or pulley system. Thus the number of pulleys in the system should be restricted, where possible.

The aforementioned arrangement means that it is possible to reduce the size of the exercise machine whilst maintaining a substantial stroke length. In order for the stroke length to take place against a fairly high resistance force it is necessary however for the resistance assembly to exhibit a substantial resistance force for, with a mechanical advantage of the order of 4, the force which is exerted on the first actuator is about a quarter of the resistance force.

The resistance assembly may be of any appropriate type. In a preferred embodiment of the invention the resistance assembly is a piston and cylinder assembly and the exercise machine includes apparatus for establishing a controlled fluid pressure inside the cylinder whereby the resistance force is dependent at least on the fluid pressure inside the cylinder.

Movement of the first actuator may cause telescoping movement of the piston and cylinder assembly.

In one form of the invention the piston includes a piston head which is mounted for reciprocating movement inside the cylinder and a piston rod which is attached to the piston head and which extends from the cylinder, the fluid pressure inside the cylinder on opposed sides of the piston head being the same, and wherein an increase in fluid pressure, due to the telescoping movement, is dependent on the extent to which the piston rod is moved into the cylinder.

The piston rod may include a hollow interior and have a sealed end which is remote from the cylinder and an open mouth which is located inside the cylinder whereby the fluid pressure in the hollow interior is the same as inside the cylinder.

In another form of the invention the piston rod is solid. The cross sectional area of the hollow interior of the piston rod and the cross sectional area of the solid piston rod, in each case, should be significantly less than the cross sectional area of the cylinder by a factor at least about 6 and preferably the ratio is of the order of 1:8 or higher.

In another form of the invention the resistance assembly includes a second cylinder which is located at least partly within the first cylinder and the second cylinder includes an inner end through which at least part of an interior of the second cylinder is placed in gas communication with the interior of the first cylinder and an outer end, the elongate member extending partly into the second cylinder with the first end of the elongate member inside the second cylinder and the second end of the elongate member extending from the outer end of the second cylinder, the reciprocating movement of the elongate member taking place inside the second cylinder, and a piston head at the first end of the elongate member which is in sealing and reciprocating contact with an opposed inner surface of the second cylinder.

Preferably the gas is air and a compressor is used to compress air inside the cylinder. A relief valve may be provided for releasing air from the cylinder. An advantage of this arrangement is that it is possible for a user to pressurise the cylinder easily to a level which sets a desired resistance force against which the user exercises.

The compressor is preferably a small device mounted in or on a housing, or part of the frame, of the exercise machine. A housing, which contains the compressor, may be provided as a footpiece attached to the frame and foot operated controls for operating the compressor and adjusting the fluid pressure inside the cylinder may be provided on the housing.

The compressor, and a motor to drive the compressor, could however be mounted remotely from the frame, particularly in a gymnasium installation wherein a number of machines could be pressurized from a single compressor.

The controls are conveniently foot-operated, particularly if the machine is "self-contained", but hand-operated controls, remotely operated controls eg. radio-based, or even voice-operated controls could be employed to regulate the pressure inside the cylinder.

As an alternative to a motor-driven compressor use could be made of a gas cylinder which contains pressurized air and which is recharged when necessary. The gas cylinder can be used to pressurize the piston and cylinder in the exercise machine in the same way as the motor-driven compressor. The gas cylinder could be "on-board" or installed at a position which is remote from the exercise machine or machines which it pressurises.

The piston rod is preferably formed with a hollow interior, ie. is tubular, and has a sealed end which is remote from the cylinder and an open mouth which is located inside the cylinder so that the fluid pressure in the hollow interior is the same as the fluid pressure inside the cylinder.

In a different embodiment of the invention the resistance assembly includes at least one resiliently deformable member. This member may be in the nature of a coil spring or the like but conveniently is an elastically extensible band. A number of bands may be used in the resistance assembly and the arrangement may be such that the number of bands may be varied according to the user's requirements to adjust the resistance force against which a user exercise. The tensions in the bands can also be adjusted to vary the resistance force.

BRIEF DESCRIPTION OF THE DRAWINGS

The invention is further described by way of examples with reference to the accompanying drawings in which.

DESCRIPTION OF PREFERRED EMBODIMENTS

Figure 1:
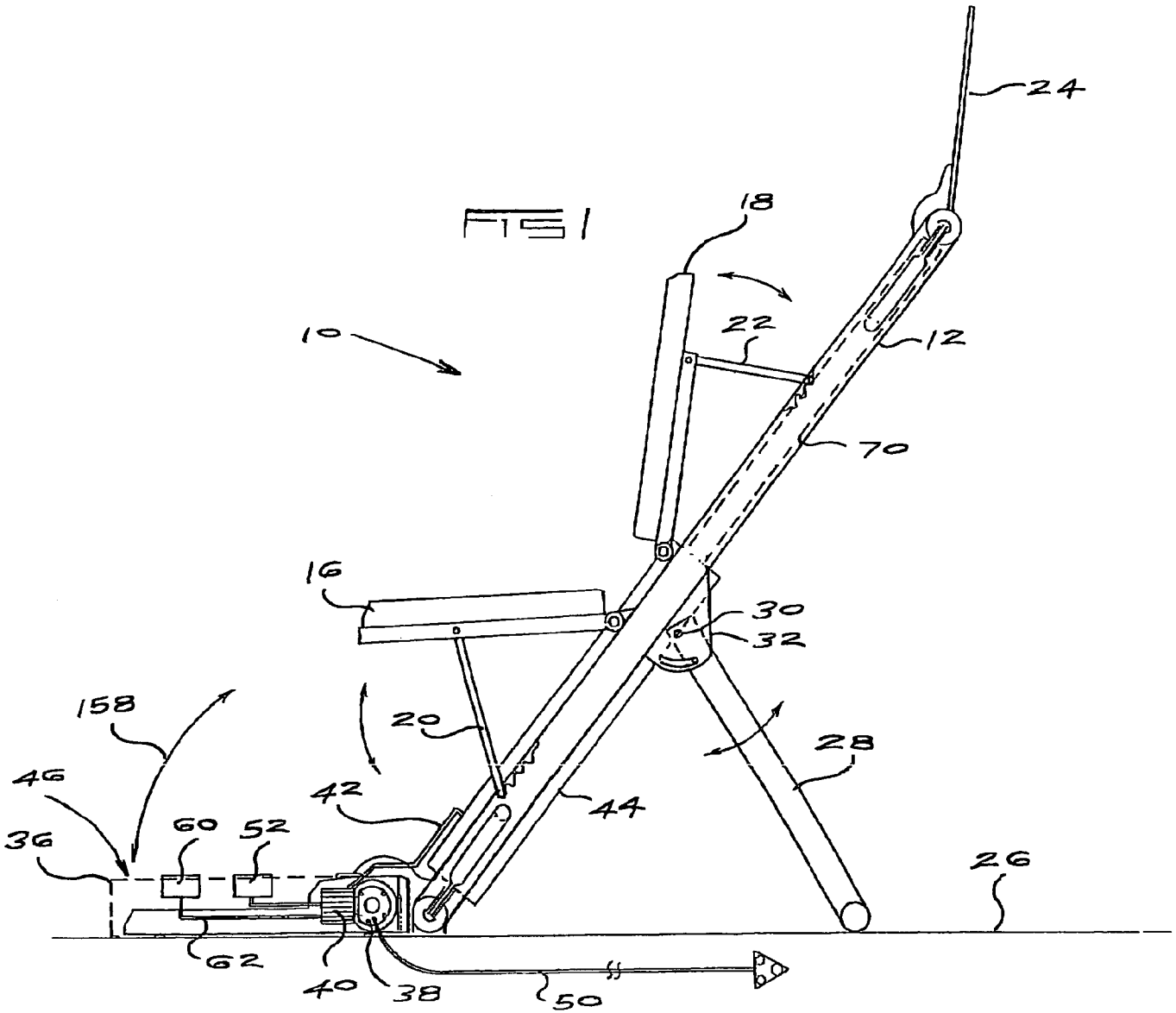
FIG. 1 is a side view of an exercise machine according to the invention in a ready-to-use state.
Figure 2:
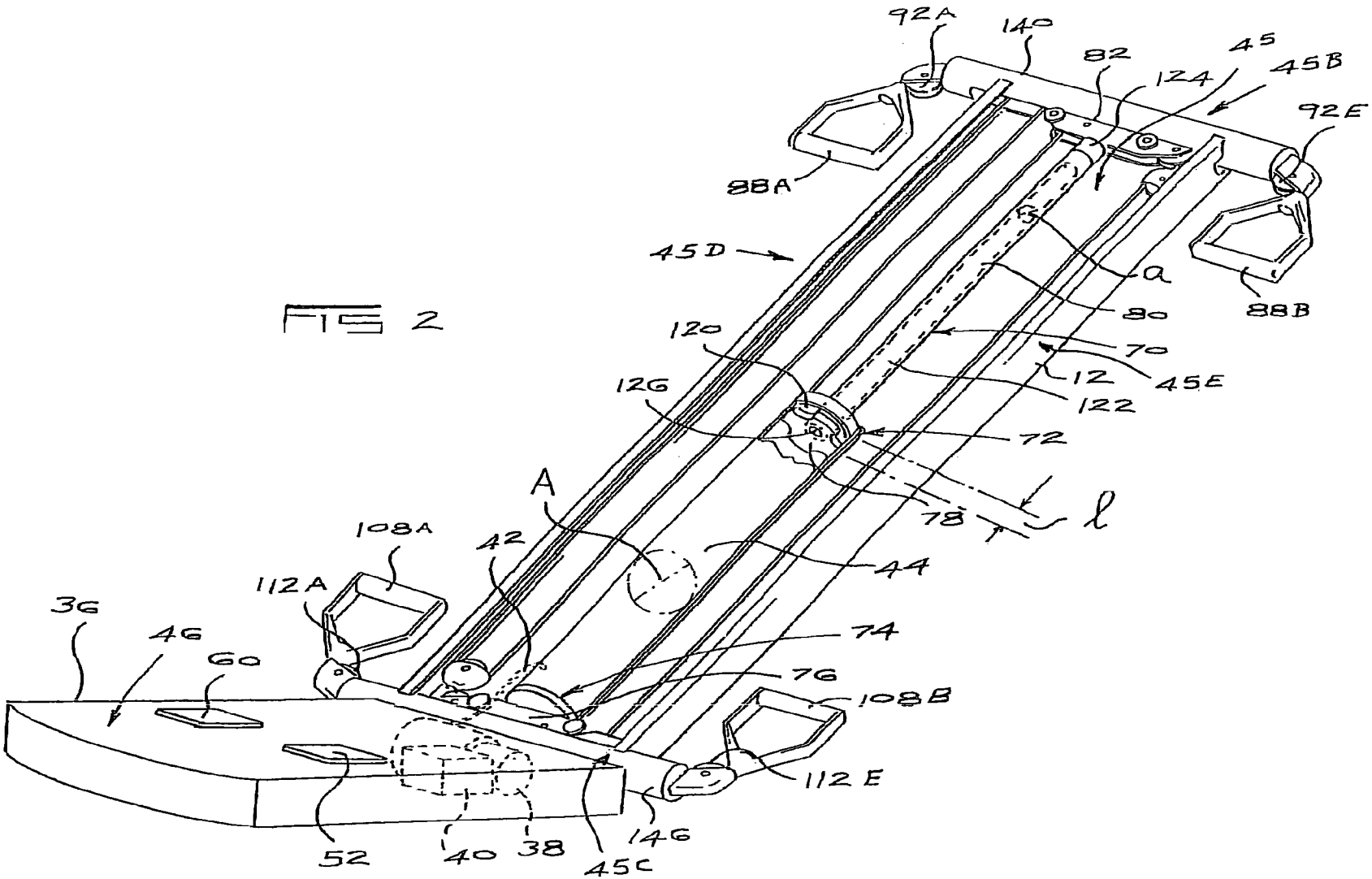
FIG. 2 is a perspective view from the front of the machine with certain components removed to simplify the illustration.
Figure 3:
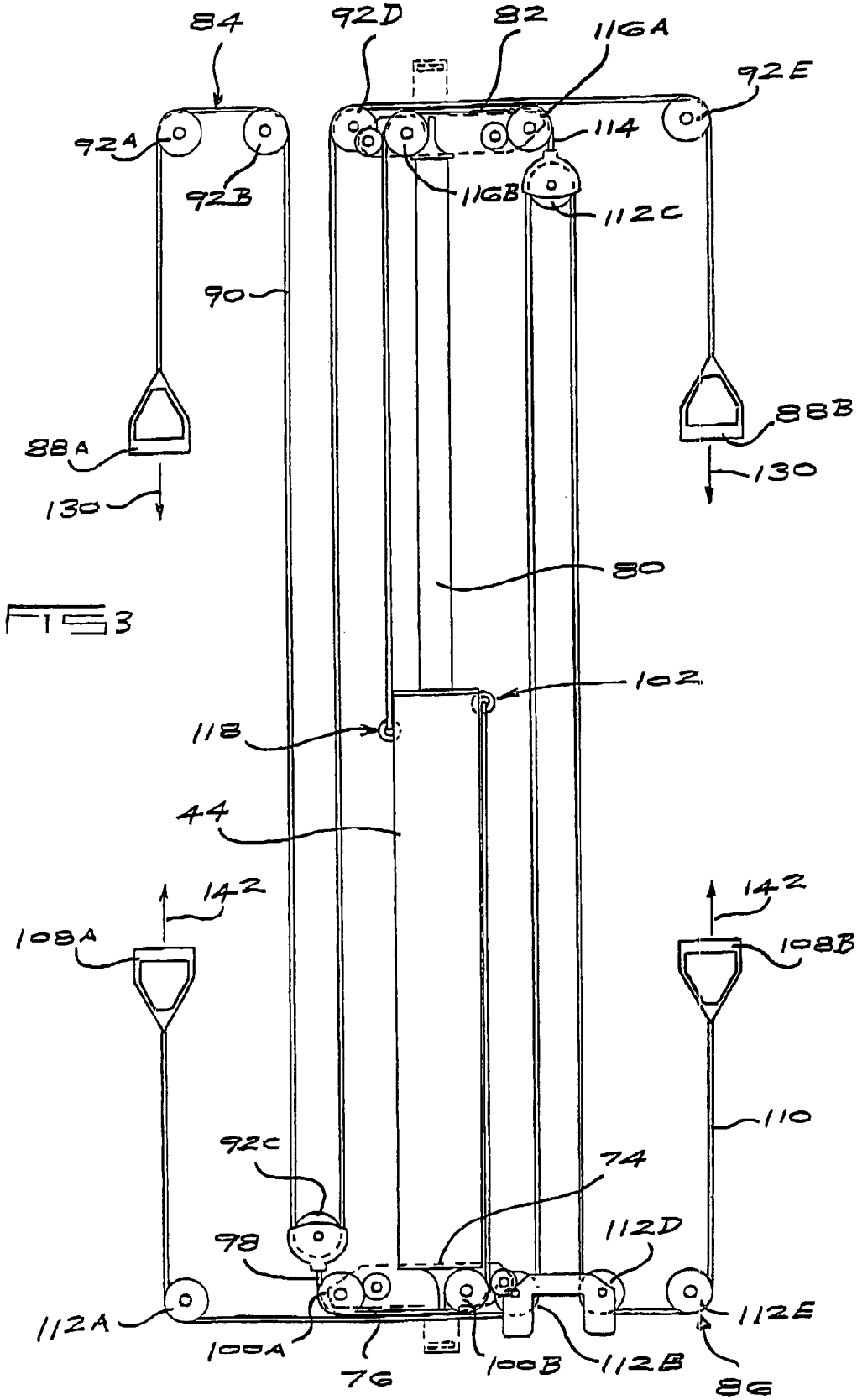
FIG. 3 illustrates moving components of the exercise machine of FIG. 1.

FIGS. 1 to 3 of the accompanying drawings illustrate an exercise machine 10 according to a first form of the invention.

The exercise machine includes an elongate frame 12 to which is attached a seat 16 on which a user can be seated, and a backrest 18 for the back of a user positioned on the seat. For storage and transport purposes the seat 16, which is normally braced by one or more stays 20, can be folded downwardly so that it is substantially parallel to the frame while, in a similar fashion, the backrest 18 which is braced by one or more stays 22 can be pivoted towards the frame to take up a compact position. A structure 24 can be used at an upper end of the frame as an holder for a card which carries information on exercise sequences.

The frame is supported at an inclined position relatively to the ground 26 by a downwardly depending U-member 28 which is attached at a pivot point 30 to brackets 32 on a rear side of the frame 12. The U-member 28 can be moved inwardly towards the frame 12 for storage and transport purposes or, as is shown in FIG. 1, can be moved away from the frame to provide a maximum degree of stable support for the frame.

The exercise machine includes a footpiece 36 at a foot of the frame. The footpiece forms a housing in which are located an electric motor 38 and an air pump or compressor 40 which is driven by the motor and which delivers air via a flexible pipe 42 to a cylinder 44 which is supported by the frame 12.

The frame 12 forms a shallow enclosure 45 with opposed upper and lower ends 45B and 45C respectively, and opposed side walls 45D and 45E respectively, and the cylinder is located in the enclosure and is supported by the frame. The cylinder is preferably completely positioned inside the enclosure so that no part thereof, even if externally visible, protrudes from the frame.

An upper surface 46 of the footpiece housing is serrated or roughened and provides a reactive surface against which feet of a user, positioned on the seat, react.

A flexible electric cord 50 extends from the motor to a main electrical supply point, not shown. A switch 52 on the footpiece 36 can be actuated by a foot of a user to connect the motor 38 to the main supply or turn the electrical supply off. In this way the operation of the motor 38 can be controlled. A pressure relief valve 60 is connected to the cylinder 44 via a flexible line 62. The pressure relief valve can also be operated by means of a foot of a user. Thus it is possible for the user to turn the compressor on and thereby pressurise the cylinder 44; turn the compressor off; or reduce the pressure inside the cylinder by actuating the valve 60.

The cylinder 44 is connected to a piston 70 to make up an assembly 72 which provides a resistance force for a user. The manner in which this is achieved is described hereinafter. The cylinder 44 has a lower end 74 which is sealed and which is mounted to a lower wheeled carriage 76. The piston 70 has a piston head 78 which is mounted for reciprocating movement inside the cylinder and a piston rod 80 which extends from the head. An upper end of the rod is mounted to an upper wheeled carriage 82.

A first pulley and cable system 84 is mounted to act on the lower carriage 76 while a second pulley and cable system 86 is mounted to act on the upper carriage 82. The system 84 includes a pair of handles 88A and 88B which are connected to each other by means of a cable 90 which passes over a succession of pulleys 92A to 92E respectively. The pulley 92C is connected to the carriage 76 by means of a cable 98 which passes over pulleys 100A and 100B on the carriage. An end of the cable 98 is attached to an anchor point 102 on the frame 12.

The system 86 has handles 108A and 108B respectively at a lower side of the frame which are connected to a cable 110 which passes over pulleys 112A to 112E respectively. The pulley 112C is connected to the carriage 82 by means of a cable 114 which passes over pulleys 116A and 116B which are mounted to the carriage. An end of the cable is tied to an anchor point 118 on the frame.

It is evident from FIG. 2 that the piston head 78 acts only in a guiding capacity within the cylinder. The piston head is formed with a plurality of notches or cut-outs 120 and consequently the pressure inside the cylinder on one side of the piston head is the same as the pressure on an opposing side of the head.

The piston rod 80 is tubular and consequently its interior 122 is hollow. A plug 124 seals an upper end of the rod 80. A lower end of the rod, which is connected to the piston head 78, is open and forms a mouth 126 which places the interior of the cylinder 44 in communication with the hollow interior of the rod.

When the exercise machine is to be used the frame 12 is positioned so that it has the orientation shown in FIG. 1. A user could be seated, kneeling or standing, while exercising. Assume that the user positions himself on the seat 16 with his back against the backrest 18. The user activates the switch 52 with one of his feet and the motor 38 is energised and then drives the compressor 40. Once the interior of the cylinder 44 has been pressurised to a desired air pressure the motor is turned off. If pressure is too high the pressure relief valve 60 is actuated to allow air to escape from the cylinder. It is therefore relatively easy for a user to adjust or control the pressure inside the cylinder using the foot-operated controls 52 and 60.

Assume that the user grips the upper handles 88A and 88B and pulls downwardly on the handles as is indicated by arrows 130 in FIG. 3. Due to the pulley and cable system 84 the lower carriage 76 is elevated and the cylinder rises with the piston moving with a telescoping action into the cylinder. A resistance force is generated which tends to act against the aforementioned movement as the rod 80 is forced into the cylinder. The effective volume which is occupied by the pressured air inside the cylinder and the hollow piston rod 80 is reduced depending on the extent to which the rod extends into the cylinder 44.

If the pressure inside the cylinder 44 is relatively high then a significant force is needed to move the rod 80 into the cylinder. However as the volume of the interior of the rod 80 is comparatively small compared to the volume of the cylinder 44, the force which is needed to move the rod into the cylinder increases only slightly as the rod is moved to a greater extent into the cylinder. In other words over the stroke length represented by the downward movement of the handles 88A and 88B, the resistance force displayed by the piston and cylinder assembly 72 increases only slightly.

Due to the mechanical advantage of the system 84 the stroke length of the handles 88A and 88B is four times the stroke length of the piston into the cylinder. Thus the piston and cylinder assembly can be relatively compact compared to the stroke length of the exercise machine. This carries a further benefit in that the change in pressure, inside the cylinder, as the assembly is telescoped is restricted because the extent of movement of the piston relatively to the cylinder is limited.

During the aforementioned telescoping movement of the assembly 72 the upper end of the piston rod is supported by the carriage 82 which in turn is supported by a bracing member or formation 140 on the frame 12. On the other hand when the handles 108A and 108B are gripped and pulled upwardly, in the direction of arrows 142, the upper carriage 82 moves downwardly and the lower end 74 of the cylinder 44, which is mounted to the lower carriage 76, is prevented from moving by a support or bracing member 146 of the frame which oppose the bracing member 140.

The handles 108A and 108B exhibit the same relatively long stroke length, compared to the stroke length of the piston into the cylinder, as the handles 88A and 88B.

The exercise machine 10 has a number of significant benefits. Firstly, it is possible for a user to adjust the pressure inside the cylinder 44 and this in turn means that the user can adjust the resistance force according to his physical condition even while exercising. The adjustment is done without the user needing to disengage his hands from the handles 88 or 108, as the case may be. Secondly, as noted, the stroke length which results when the handles 88 or 108 are used is four times the stroke length of the piston into the cylinder. This allows for a compact construction of the exercise machine.

Thirdly, the number of pulleys in each of the systems 84 and 86 is relatively low and this means that frictional losses are kept to a minimum. Consequently the positive resistance force displayed by the piston and cylinder assembly 72 (ie. the force which results when the handles 88 are moved in the direction of the arrows 130 or when the handles 108 are moved in the direction of the arrows 142) is only slightly greater than the negative resistance force which is the force produced when the air inside the cylinder 44 expands to restore the piston and cylinder assembly to its extended position.

A further benefit, already alluded to, is that the force which is needed to drive the piston rod deeper into the cylinder increases only slightly as the rod is moved into the cylinder. This force is a function of the pressure inside the cylinder and if the pressure is sufficiently high the relative increase in the force, as the piston moves into the cylinder, is comparatively low. The extent to which the force increases is a function of the relative volumes of the cylinder 44 and of the interior of the hollow rod 80.

The exercise machine is lightweight. The resistance force results from the use of a cylinder and piston assembly which is pressurised with air by a user to a chosen, controlled level which is readily adjustable. The need for heavy weights is therefore eliminated. The exercise machine can be folded compactly into a fairly flat arrangement which can, for example, be stored under a bed or behind a door when not required. To achieve this the seat and the footpiece are folded from their respective operative portions to respective storage positions at which the seat and footpiece overlie respective parts of the enclosure. In this respect it should be observed that the compressor and motor are mounted in the housing 36 and are therefore integrally associated with the exercise machine. As is indicated by a curved arrow 158 in FIG. 1 the housing can be folded upwardly to a compact storage position, adjacent the frame, when required. The exercise machine is thus a fully self-contained unit and only requires connection to an electrical supply to become operational. The same principles could however be employed to provide an exercise machine, which may be one of a plurality of similar machines, which is pressurized from a remotely installed compressor. The pressure in each machine could then be controlled as required by each respective user.

In each case the controls could be foot-operated. However hand-operated, remotely activated, and voice actuated controls could also be used to regulate the pressure in the cylinder.

Figure 4:
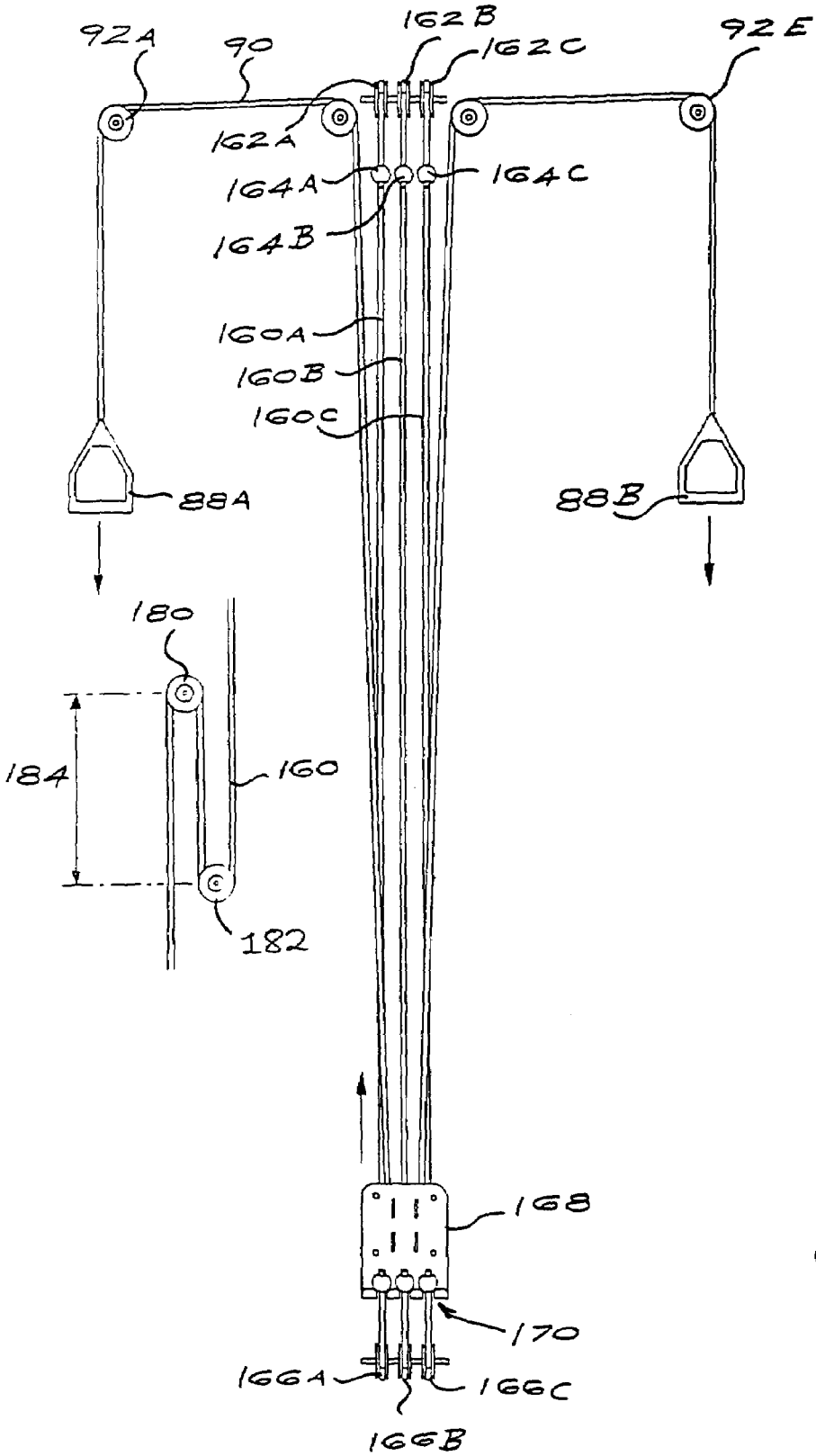
FIG. 4 is a view similar to FIG. 3 of an exercise machine which makes use of a resistance assembly which differs from the resistance assembly which is employed in the machine of FIGS. 1 to 3.
Figure 5:
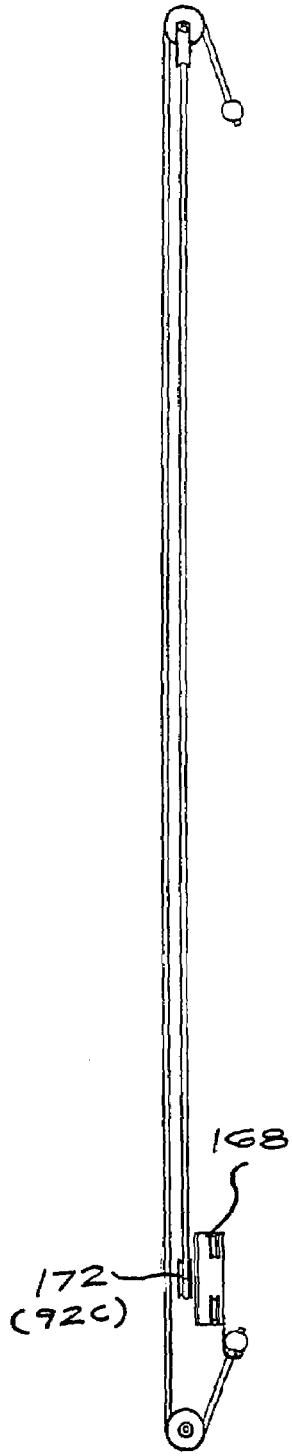
FIG. 5 is a side view of the arrangement of FIG. 4.
Figure 6:
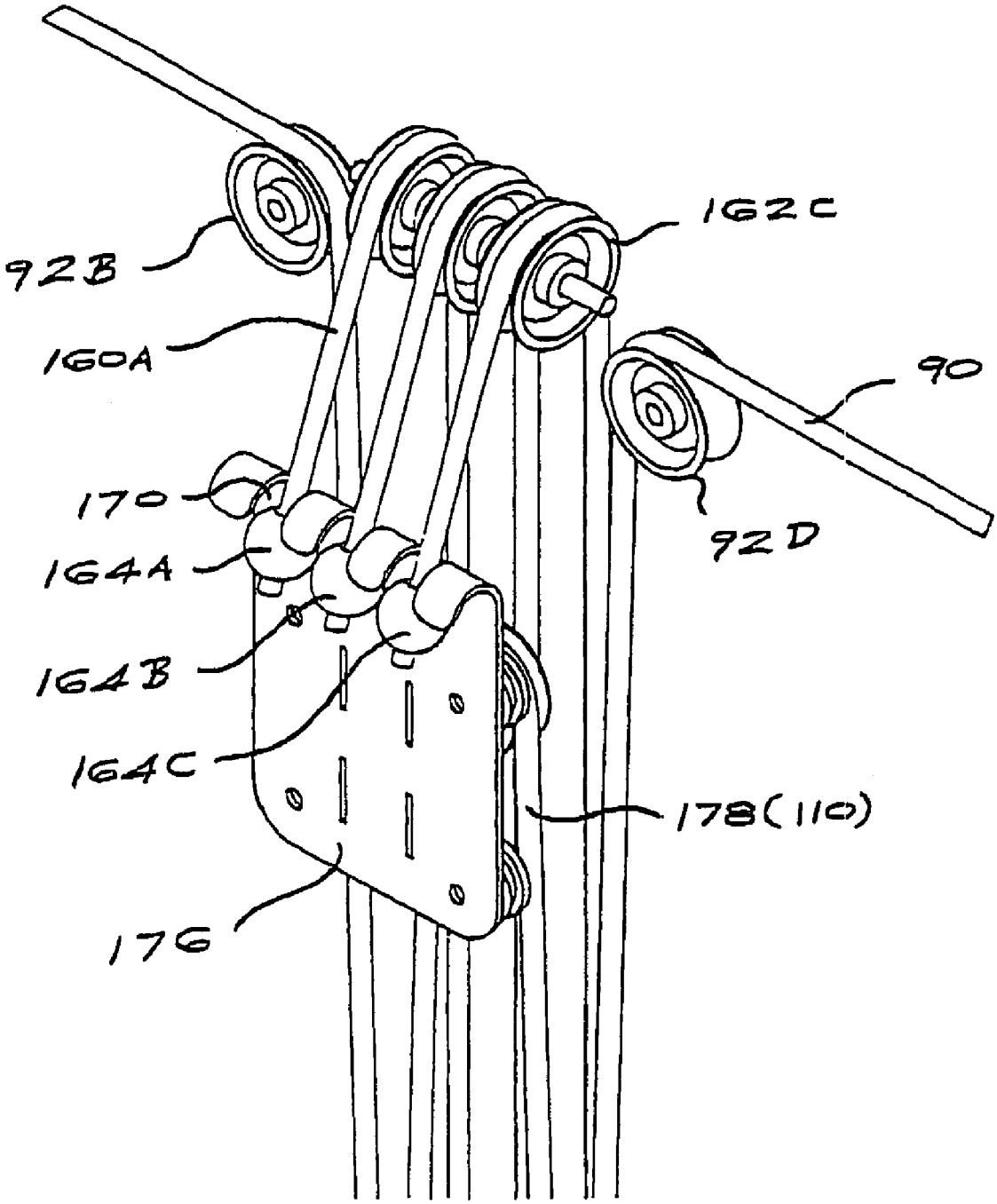
FIG. 6 is an enlarged perspective view of a connection plate used in the arrangement of FIG. 4.

FIGS. 4 to 6 illustrate a modification which can be made to the machine 10. Use is made of a plurality of elastic bands 160 in place of the piston and cylinder assembly 72. Where applicable like reference numerals are used to designate like components.

FIG. 4 shows three bands designated 160A, 160B and 160C which pass over corresponding pulleys 162A, 162B and 162C. Ends of the bands are terminated in knobs 164A to 164C respectively.

A corresponding construction is adopted for the bands at their lower ends. As is shown in FIG. 4 the lower ends of the bands pass around pulleys 166 which are similar to the pulleys 162. The lower ends are attached to a plate 168. In each case the knob of a respective band is engaged with a slot 170 in the plate.

The plate 168 has a pulley 172 fixed to its rear side. An inextensible cable 90 passes over pulleys 92 and is terminated in handles 88, similar to what is shown in FIG. 3. It is apparent that the pulley 172 serves the same function as the pulley 92C and that the plate 168 is equivalent to the lower carriage 76. When the handles 88A and 88B are pulled downwardly the plate 168 is moved upwardly and the bands 160 are tensioned. The lower ends of the bands move upwardly while the upper ends which are fixed to the knobs 164 remain stationary.

In reality the knobs 164 at the upper ends of the bands are fixed to a plate 176 which is similar to the plate 168 and which acts in the same way as the upper carriage 82 (see FIG. 6). A cable 178, which is equivalent to the cable 110 and which terminates in handles 108A and 108B similar to those shown in FIG. 3, passes around a corresponding set of pulleys and acts on the upper plate 176. If an upwards pulling force is applied to the handles which are fixed to the ends of the cable 178 the plate 176 is moved downwardly with the lower plate 168 then remaining stationary.

The exercise machine modified in accordance with FIGS. 4 to 6 provides a dual-acting arrangement in which a pulling or pushing force can be exerted upwardly or downwardly and wherein the mechanical advantage of the modified system is at a chosen value, typically 4:1. Three bands are shown in FIG. 4. This number can be varied by a user who can select one, two or three bands against which to exercise.

Normally the bands, at the rest position shown in FIG. 4, are relatively unextended and the resistance force, at the start of a stroke length, is relatively low. It is possible though to provide an adjustment mechanism in that one or more bands can be passed around intermediate pulleys 180 and 182 as is shown in the inset drawing in FIG. 4. If the distance 184 between the axes on which the respective pulleys rotate, is adjusted, then the band tension can be adjusted as well. This is equivalent to varying the air pressure in the piston and cylinder assembly shown in FIG. 1.

Figure 7:
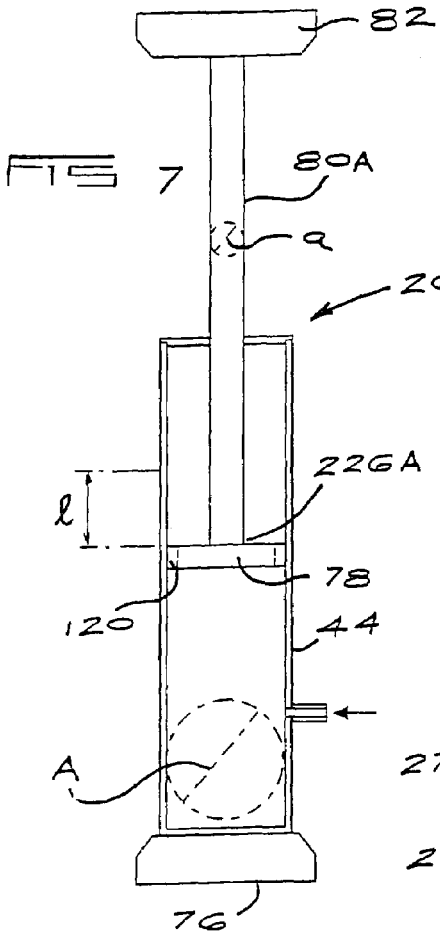
FIGS. 7 and 8 respectively show alternative types of resistance assemblies suited for use in the exercise machine of the invention.

FIG. 7 illustrates, somewhat schematically, a resistance assembly 260, according to another form of the invention, which can be used in place of the resistance assembly 72 shown in FIGS. 2 and 3. The resistance assembly 260 has a number of similarities to the assembly 72 and consequently, where appropriate, like reference numerals are used to designate like components. The assembly 260 is not shown installed in an exercise machine. It can be used in the same way as the assembly 72, as shown in FIGS. 1 to 3.

The principal difference between the assembly 72 and the assembly 260 is that the piston rod, designated 80A in the assembly 260 is solid. Alternatively, if the rod is hollow, the lower end of the rod, designated 226A, is sealed by means of a plate or plug so that it is airtight.

The interior of the cylinder 44 is, as before, pressurized by means of a compressor or a gas cylinder.

The piston head 78 also has notches or cut-outs 120 which ensure that the pressure inside the cylinder on an upper side of the piston head is the same as the pressure on a lower side of the piston head.

When the piston rod is caused to move relatively to the cylinder (with the cylinder stationary) or if the cylinder is caused to reciprocate relatively to the piston rod (with the piston rod stationary) the air inside the cylinder is further pressurized as the rod 80A is moved to a greater extent into the cylinder while the pressure is slightly reduced as the rod is retracted from the cylinder. The operation is substantially the same as for the resistance assembly 72 except that for the assembly 72 the maximum volume occupied by the pressurized air is equal to the sum of the volume of the cylinder and of the volume of the interior of the hollow piston rod while the minimum volume is equal to the volume of the cylinder minus the volume of the piston rod. With the assembly 260 the maximum volume occupied by the pressurized air is slightly less than for the assembly 72 and is equal to the volume of the cylinder. The minimum volume is also slightly decreased in that it is equal to the volume of the cylinder minus the volume of the solid or sealed piston rod. In substance however the resistance assembly 260 offers the same benefits as the resistance assembly 72.

Figure 8:
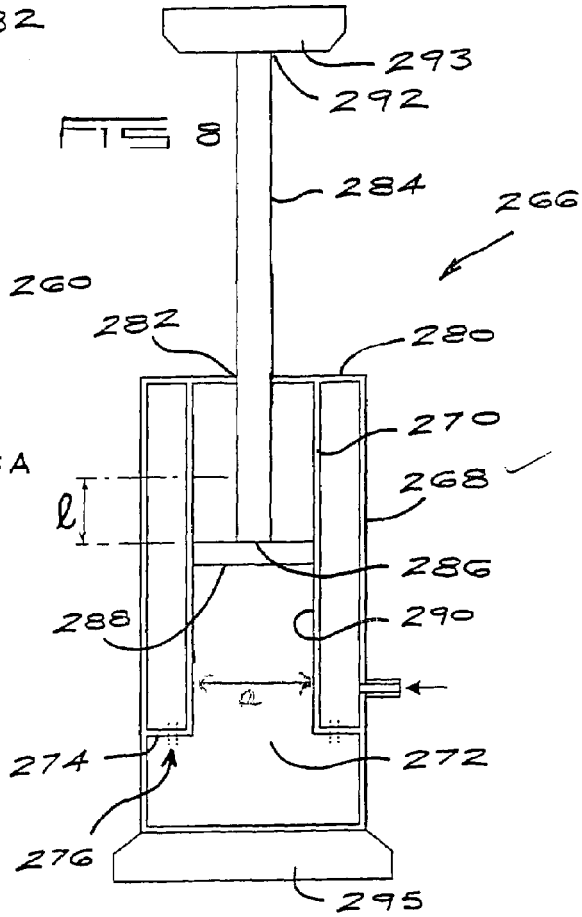

FIG. 8 illustrates another resistance assembly 266 which is also equivalent to the assembly 72. The assembly 266 includes a first or outer cylinder 268 and a second cylinder 270 which is positioned inside the cylinder 268. A lower end 272 of the cylinder 270 is open and is supported by a plate 274 in which is formed a plurality of holes 276. An upper end of the cylinder 270 is supported by a plate 280 which is sealingly engaged with the cylinders 268 and 270 and which includes a hole or plug 282 through which a piston rod 284 extends. A leading end 286 of the piston rod carries a piston head 288 which is slidingly and sealingly engaged with an inner surface 290 of the second cylinder 270. An outer or upper end 292 of the rod 284 is engaged with suitable structure 293 on an exercise machine (not shown). Similarly a lower end of the cylinder 268 is attached to suitable structure of the 295 exercise machine. The resistance assembly 266 can for example be used in the manner shown in FIG. 2 in place of the assembly 72.

The cylinder 268 and the cylinder 270 are simultaneously pressurized with pressurized air from the compressor in the footpiece (not shown).

The piston head 288 performs the same function as the hollow rod 80 in FIG. 2 or the solid rod 80A in FIG. 7 for as the piston head 288 advances into the cylinder 270 the air in both cylinders is pressurized depending on the total volume of air which is displaced by the advancing piston head.

Figure 9:
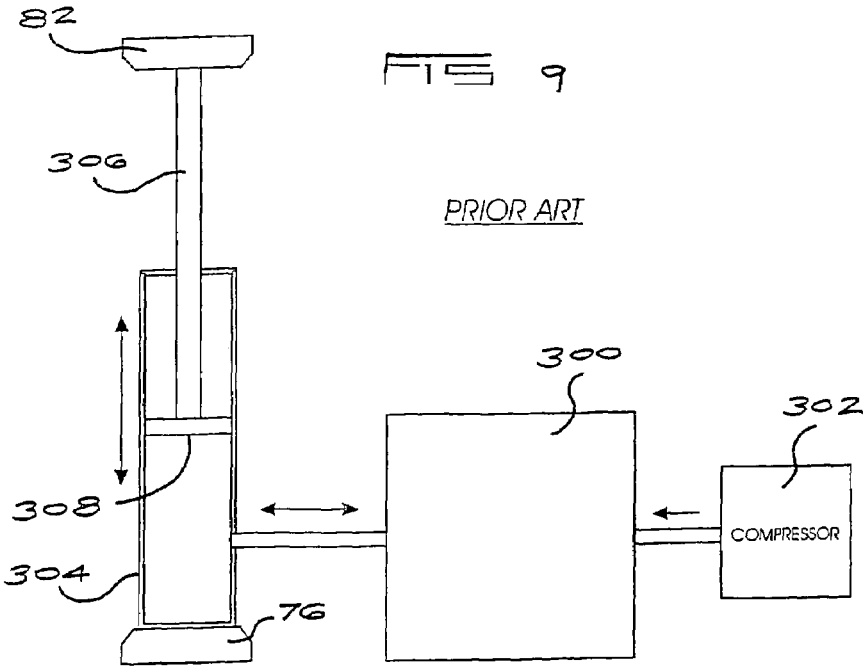
FIG 9 PRIOR ART
FIG. 9 schematically depicts a prior art type of resistance assembly.

The situation which arises in the exercise machine of the invention should be contrasted with the prior art situation shown schematically in FIG. 9 which illustrates a reservoir or accumulator 300 which is pressurized with air from an air source 302 eg. a compressor. A separate resistance cylinder 304 of relatively small construction is connected to the reservoir. The cylinder 304 includes a piston rod 306 with a piston head 308 which is mounted for reciprocating and sealing movement inside the cylinder 304. As is evident from prior art documents exercise machines which make use of the prior art arrangement shown in FIG. 8 are bulky for they require at least two separate cylinders. If the prior art arrangement is employed in an exercise machine then it is difficult to provide a compact exercise machine which, in an inoperative storage mode, is adapted for easy transport or storage. This specific objective is however met by the exercise machine of the invention.

With the resistance assemblies 72 and 260 the effective cross sectional area of the piston rod determines the volume of air which is displaced when the piston rod is moved into the cylinder. Referring to FIG. 2 assume that the piston rod has a cross sectional area a in its hollow interior and that the cylinder 44 has a cross sectional area A. When the rod is moved into the cylinder by a distance l the volume of air which is displaced is given by the expression $l \times a$. As the cross sectional area a is substantial less than the cross sectional area A of the cylinder 44 the change in pressure inside the cylinder is relatively small and to a substantial extent the piston moves against a force which does not increase significantly with piston rod movement.

In the FIG. 7 embodiment the cross sectional area of the solid piston rod 80A is a and when the piston rod is advanced into the cylinder 44 by a distance l the volume of air displaced is $a \times l$ which, again, is substantially less than what would be case if the piston head 78 were large and were sealingly engaged with the cylinder 44.

In the FIG. 8 embodiment the cross sectional area of the piston 288 is a and, when the piston is advanced by a distance l into the cylinder 270, the volume of air displaced is given by the expression $a \times l$.

In the embodiments respectively shown in FIGS. 1 to 3, FIG. 7 and FIG. 8 if a is substantially less than the cross sectional area A of the cylinder 44 or the effective cross sectional area of the cylinder 168, as the case may be, then there is only a marginal increase in the resistance force as the piston is moved from a position at which it is fully retracted from the cylinder to a position at which it is fully inserted into the cylinder. Although it is possible with the prior art arrangement shown in FIG. 9 to achieve a similar relatively small variation in air pressure this is at the expense of at least one additional space consuming component.

The ratio of A to a should be at least 6 but preferably higher. In this respect a compromise must be struck between the resistance force which is generated (this is a function of the product of a and the air pressure inside the cylinder) and the change in the resistance force during a piston stroke.

Figure 10:
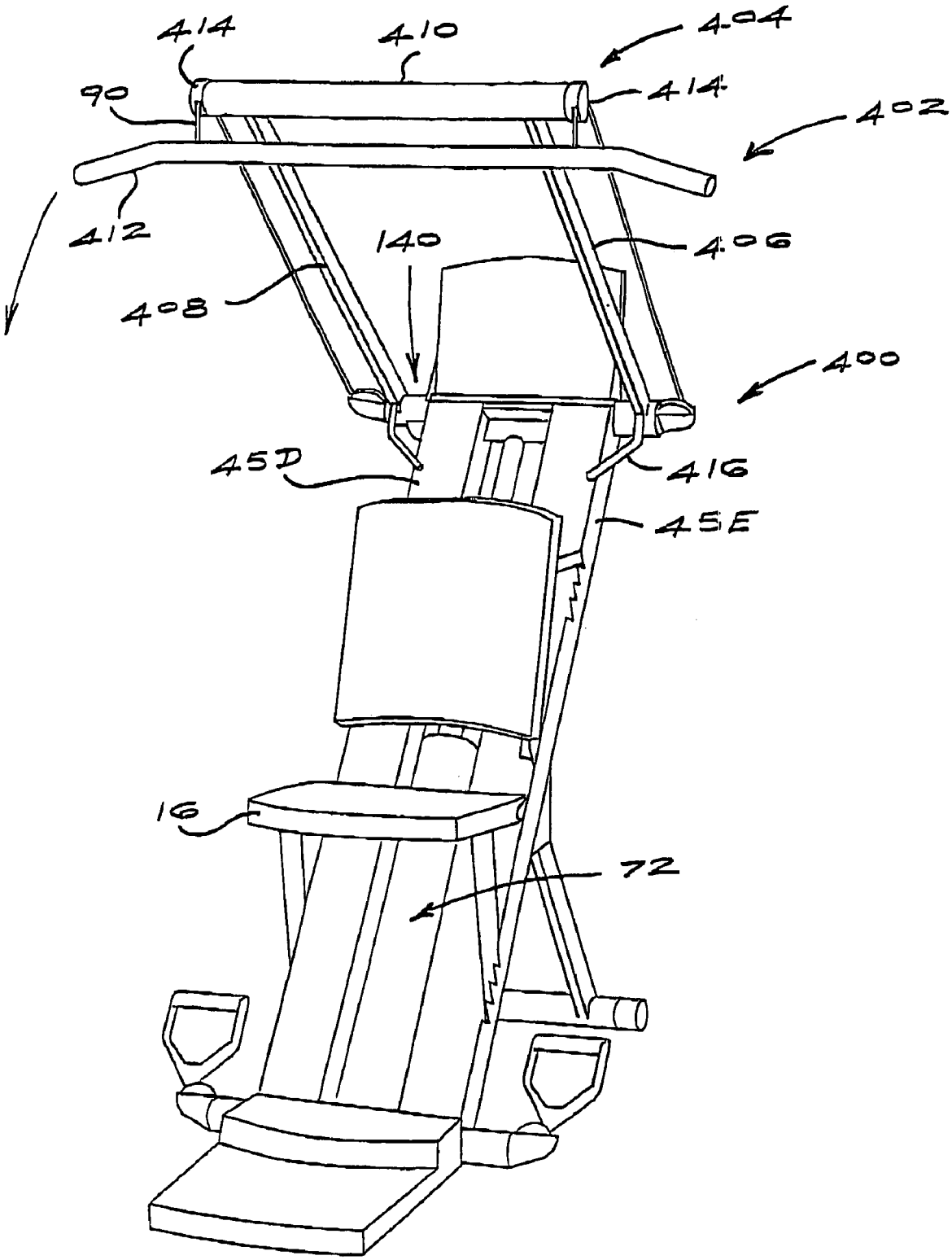
FIGS. 10 and 11 respectively illustrate variations which can be made to the exercise machine to increase the range of exercises which are possible with the machine.

FIG. 10 illustrates an exercise machine 400 which is substantially similar to what is shown in FIGS. 1 to 3. However an upper end 402 of the frame includes a support 404 which extends from the frame at least partly over the front side ie. the side of the frame which faces upwardly. The support includes two levers 406 and 408 which are joined at their extremities to a cross bar 410 and which, at opposing ends, are pivotally mounted to the bracing member 140. The handles 88A and 88B are done away with and the ends of the cable 90 which extend to the handles are, instead, connected to a lateral bar 412. The cables pass over pulleys 414 on the cross bar and formations on the cross bar ensure that the cables are retained captive in the pulleys. If the cross bar 412 is not used then the handles 88A and 88B can be retained, and the user's arms will not be constrained to work in unison.

Stops 416 at lower ends of the levers 406 and 408 enable the support 404 to be pivoted downwardly to a rear side of the frame ie. the side of the frame which faces downwardly for storage and transport purposes. The stops 416 can also be adjusted, eg in position, orientation or shape, so that the inclinations of the levers 406 and 408 can be varied. This in turn changes the height of the cross bar above the user, and alters the nature of the exercise. On the other hand, in the operative position shown in FIG. 10, the stops abut the side walls 45D and 45E of the frame with the support in a limiting position. A user who is seated on the seat 16 is thus able to grasp opposed ends of the lateral bar 412 and exercise by pulling downwardly on the bar against the resistance force which is generated by the resistance assembly 72.

All of the benefits which have been alluded to hereinbefore and which are associated with the exercise machine of the invention are displayed by the exercise machine 400.

Figure 11:
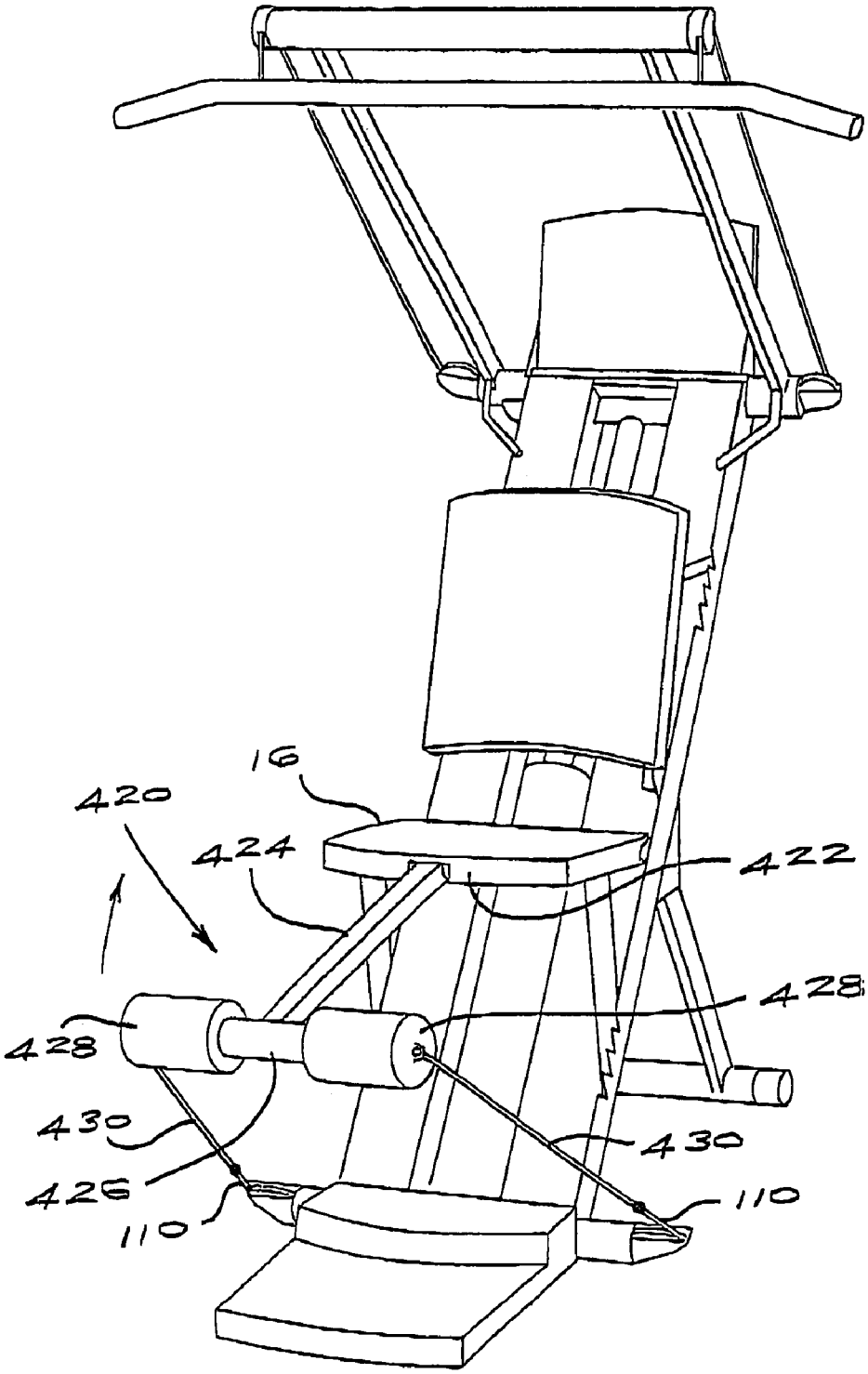

FIG. 11 illustrates another variation which can be made to the machine of the invention. In this instance structure 420 is pivotally attached to an outer edge 422 of the seat 16. The structure 420 is optional and consequently the design of the pivotal attachment is such that the structure can be engaged with the seat, or be can be disengaged from the seat, as required.

The structure 420 includes a downwardly extending member 424 which, at its lower end, has a relatively small cross piece 426 extending in opposed directions. The cross piece carries pads 428 on each of its projecting sides.

Each end of the cross piece 426 is respectively connected by means of a link 430 to an end of the cable 110 which normally extends to the lower handles 108A and 108B. These handles are detached from the cable.

The arrangement of the structure 420 is such that a user on the seat 16 is able to engage his feet or ankles with the pads 428 on the cross piece 426. While remaining on the seat 16 the user can raise his legs against a resistance force which is exerted by the resistance assembly 72 and which is transmitted via the links 430 to the structure 420.

In a variation the member 424 is not used. The cross piece 426 is retained, though, and is only connected to the links 430. The leg movement is then not constrained by the pivotal action of the member 424.

Figure 12:
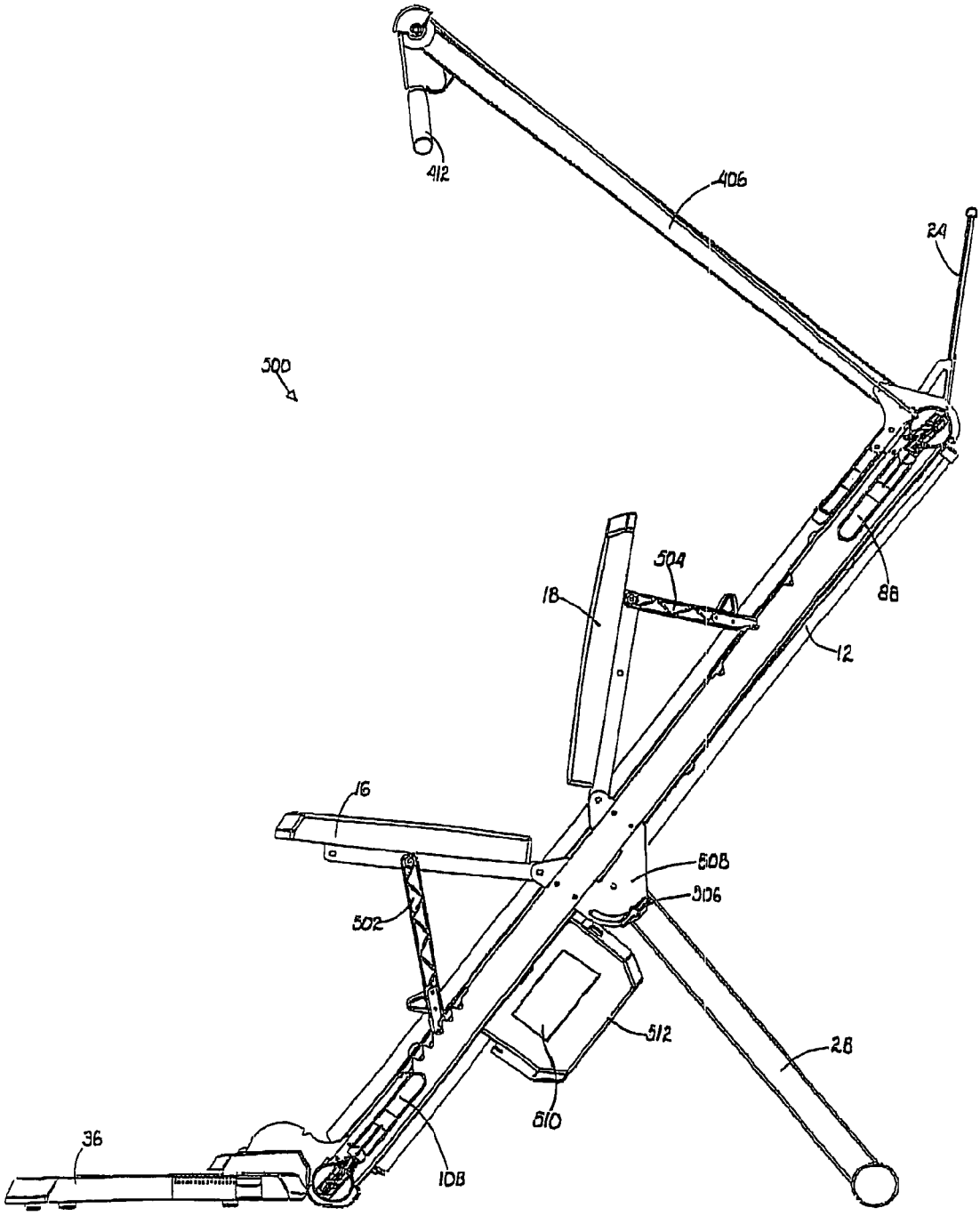
FIGS. 12 and 13 are side views of an exercise machine according to a variation of the invention in operative and storage modes respectively.
Figure 13:
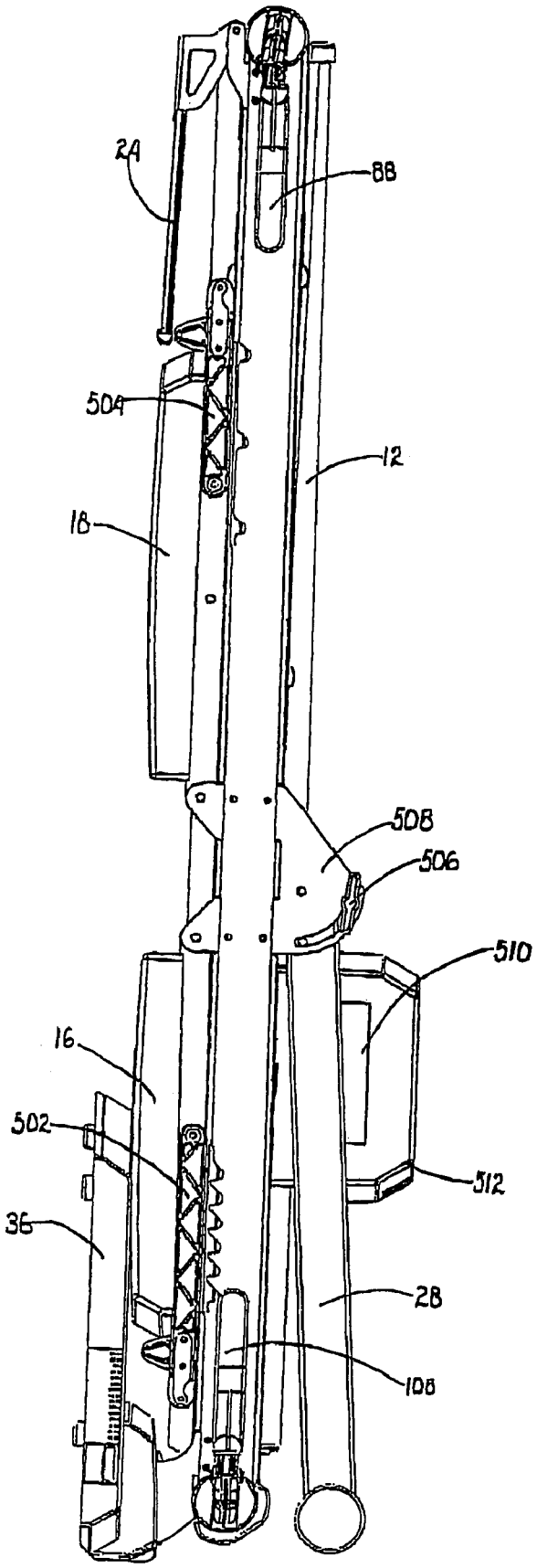

FIGS. 12 and 13 illustrate an exercise machine 500 according to a slightly revised form of the invention in operative and storage modes respectively. Where applicable like reference numerals are used to designate like components and the construction of the exercise machine 500 is not described in detail.

The exercise machine includes a frame 12, generally of the kind described hereinbefore, which houses a cylinder and piston resistance assembly. Levers 406 with a cross lateral bar 412 are mounted at an upper end of the frame and, at opposing end, the exercise machine includes a footpiece 36. A seat 16 and a backrest 18 are mounted to a front, upwardly inclined side of the frame while a U-shaped support member 28 is mounted to a rear side of the support frame which is inclined and faces downwardly.

The seat can be fixed in an operative position, as shown in FIG. 12, by means of an adjustable stay 502 while the backrest 18 is similarly fixed in an operative position, as shown in FIG. 12, by means of an adjustable stay 504. The U-shaped support member on the other hand can be kept in a chosen operative position by means of one or more fasteners 506 which are clamped against a plate 508 to which the member is pivotally mounted.

The footpiece 36 includes foot operated controls for controlling the operation of a compressor and for controlling the release of air from the resistance device mounted in the frame. In contrast to the construction shown in FIG. 1 though the compressor and motor 510, used for providing compressed air to the piston and cylinder resistance assembly, are mounted in a housing 512 which is fixed to the rear side of the frame.

A significant benefit of the exercise machine of the invention lies in the fact that it is possible to detach the levers 406 and the cross and lateral bars from the upper end of the frame. The backrest and the seat can then be moved to storage positions, as shown in FIG. 13, at which these components overlie parts of the front side of the frame while the support member 28 can be folded so that it is adjacent the rear side with the housing 512 being positioned between opposed limbs of the U-shaped support member. The footpiece 36 is pivoted upwardly to overlie a portion of the seat on a front side of the frame.

The exercise machine, in the compact folded or storage configuration shown in FIG. 13, occupies a relatively small volume to facilitate storage and transport of the device. This is particularly important for it enables the machine to be acquired and used by a person who possibly does not have sufficient space to allow the machine to remain fully erected at all times.

The invention claimed is:

1. An exercise machine comprising:

a frame;

a piston and cylinder assembly which is supported by the frame;

an apparatus for establishing a controlled fluid pressure inside the cylinder;

a first actuator which is movable by a user from a first rest position against a first resistance force which is dependent at least on the fluid pressure inside the cylinder, to cause telescopic movement of the piston and cylinder assembly, the first actuator including at least a first device which is movable by the user and a first mechanical advantage system connected to the piston and cylinder assembly whereby movement of the first device by a first distance causes corresponding telescopic movement of the piston and cylinder assembly by a second distance which is smaller than the first distance; and a second actuator which is movable by the user from a second rest position against a second resistance force which is dependent at least on the fluid pressure inside the cylinder, to cause telescopic movement of the piston and cylinder assembly, the second actuator including at least a second device which is movable by the user and a second mechanical advantage system connected to the piston and cylinder assembly whereby movement of the second device by a third distance causes corresponding telescopic movement of the piston and cylinder assembly by a fourth distance which is smaller than the third distance;

wherein the fluid pressure in the cylinder is increased by the telescopic movement of the piston and cylinder assembly, and exerts a force which tends to extend the assembly and restore the first actuator to the first rest position and the second actuator to the second rest position, wherein the piston includes a piston head which is mounted for reciprocating movement inside the cylinder and a piston rod which is attached to the piston head and which extends from the cylinder, the piston rod having a hollow interior, a sealed end which is remote from the cylinder and an open mouth which is located inside the cylinder whereby the fluid pressure in the hollow interior is the same as inside the cylinder, the fluid pressure inside the cylinder on opposed sides of the piston head being the same, and wherein the increase in fluid pressure in the cylinder due to the telescopic movement of the piston and cylinder assembly, is dependent on the extent to which the piston rod extends into the cylinder.

2. An exercise machine according to claim 1 wherein the piston and cylinder assembly includes first and second ends and wherein when the assembly is caused to move by the first actuator, the first end engages with a first support on the frame, and the second end moves relatively to the frame, and wherein when the assembly is caused to move by the second actuator, the second end engages with a second support on the frame and the first end moves relatively to the frame.

3. An exercise machine according to claim 1 wherein the apparatus includes a fluid pump for pressurising fluid inside the cylinder and a pressure relief device for reducing in a controlled manner the pressure of the fluid inside the cylinder.

4. An exercise machine according to claim 3 wherein the apparatus is positioned inside a housing which is mounted to the frame.

5. An exercise machine according to claim 4 wherein the housing forms a footpiece at a lower end of the frame and which includes a first control mounted to the footpiece for controlling the fluid pump and a second control mounted to the footpiece for controlling the pressure relief device.

6. An exercise machine according to claim 1 wherein the apparatus includes a gas-pressurised cylinder.

7. An exercise machine according to claim 1 which includes controls for controlling the fluid pressure inside the cylinder.

8. An exercise machine according to claim 7 wherein the controls are foot-operated.

9. An exercise machine according to claim 1 wherein the frame is elongate with a lower end and an upper end and which includes at least one support member to support the frame at an inclined position relatively to the ground.

10. An exercise machine according to claim 9 which includes a seat which is mounted to the frame between the lower end and the upper end thereof.

11. An exercise machine according to claim 10 which includes a footpiece at the lower end of the frame.

12. An exercise machine according to claim 11 which includes at least one control for controlling the resistance force.

13. An exercise machine according to claim 12 wherein the at least one control is mounted to the footpiece.

14. An exercise machine according to claim 9 wherein the inclined frame has an upwardly facing front side and a downwardly facing rear side and wherein the first actuator further includes a support which extends from the upper end of the frame at least partly over the front side and the first device includes at least one handle which is supported by, or which forms part of, the support and which is connected to the first mechanical advantage system.

15. An exercise machine according to claim 10 which includes a structure which is pivotally mounted to the seat, at least one formation on the structure against which at least one foot of a user, on the seat, reacts, and at least one link between the structure and the second actuator whereby movement of the structure relatively to the seat results in movement of the piston and cylinder assembly.

16. An exercise machine according to claim 1 wherein the frame is elongate with opposed upper and lower ends and opposed side walls which form an enclosure and the piston and cylinder assembly is supported inside the enclosure.

17. An exercise machine according to claim 16 which includes a seat which is mounted to the frame between the upper and lower ends thereof, the seat being movable between an operative position and a storage position at which the seat overlies a first part of the enclosure and of the piston and cylinder assembly and a footpiece at the lower end of the frame which is movable between an operative position and a storage position at which the footpiece overlies a second part of the enclosure and of the piston and cylinder assembly.

18. An exercise machine according to claim 1 wherein the first device includes first and second handles which are positioned at an upper end of the frame near respective opposing sides of the frame and which are connected to the first mechanical advantage system.

19. An exercise machine according to claim 18 wherein the second device includes third and fourth handles which are positioned at a lower end of the frame which opposes the upper end, and near opposing sides of the frame, and which are connected to the second mechanical advantage system.

* * * * *